US009907408B2

(12) United States Patent
Vrzalik et al.

(10) Patent No.: US 9,907,408 B2
(45) Date of Patent: Mar. 6, 2018

(54) MULTI-LAYERED SUPPORT SYSTEM

(75) Inventors: John H. Vrzalik, San Antonio, TX (US); Cesar Lina, Universal City, TX (US); Glenn C. Stroh, Marion, TX (US)

(73) Assignee: Huntleigh Technology Limited (GB)

( * ) Notice: Subject to any disclaimer, the term of this patent is extended or adjusted under 35 U.S.C. 154(b) by 0 days.

(21) Appl. No.: 12/622,260

(22) Filed: Nov. 19, 2009

(65) Prior Publication Data

US 2010/0122417 A1 May 20, 2010

Related U.S. Application Data

(60) Provisional application No. 61/116,095, filed on Nov. 19, 2008.

(51) Int. Cl.

| | |
|---|---|
| ***A47C 21/00*** | (2006.01) |
| ***A47C 21/04*** | (2006.01) |
| ***A47C 27/00*** | (2006.01) |
| ***A47C 27/14*** | (2006.01) |
| ***A47C 27/15*** | (2006.01) |
| ***A47C 31/00*** | (2006.01) |
| ***A61G 7/057*** | (2006.01) |

(52) U.S. Cl.

CPC ..... *A47C 21/046* (2013.01); *A47C 27/007* (2013.01); *A47C 27/144* (2013.01); *A47C 27/15* (2013.01); *A47C 31/006* (2013.01); *A61G 7/05792* (2016.11)

(58) Field of Classification Search

USPC ..... 5/690, 724, 737, 652.1, 653, 717, 704, 5/939

See application file for complete search history.

(56) References Cited

U.S. PATENT DOCUMENTS

| | | | | |
|---|---|---|---|---|
| 2,826,244 A | | 3/1958 | Hurley | 5/652.2 |
| 3,735,559 A | | 5/1973 | Salemme | 95/52 |
| 4,185,341 A | | 1/1980 | Scales | 5/699 |
| 4,483,030 A | | 11/1984 | Flick et al. | 5/691 |
| 4,665,575 A | * | 5/1987 | Raught | 5/722 |
| 4,825,488 A | | 5/1989 | Bedford | 5/726 |
| 4,853,992 A | | 8/1989 | Yu | 5/423 |
| 4,997,230 A | | 3/1991 | Spitalnick | 297/180.11 |
| 5,007,123 A | | 4/1991 | Salyards | 5/699 |
| 5,035,014 A | | 7/1991 | Blanchard | 5/424 |
| 5,090,074 A | * | 2/1992 | Scales et al. | 5/699 |

(Continued)

FOREIGN PATENT DOCUMENTS

| | | |
|---|---|---|
| DE | 203 06 348 | 9/2003 |
| DE | 203 09 793 | 10/2003 |

(Continued)

OTHER PUBLICATIONS

Extended European Search Report issued in European Patent Application No. 09828235.3, dated Sep. 21, 2012.

(Continued)

*Primary Examiner* — Richard G Davis

(74) *Attorney, Agent, or Firm* — The Webb Law Firm

(57) ABSTRACT

In various embodiments, a support system includes a multi-layer support system with a number of layers. Systems and methods of removing moisture vapor from an environment surrounding patient are disclosed that accomplish such removal without the use of powered air-movers.

14 Claims, 6 Drawing Sheets

(56) References Cited

U.S. PATENT DOCUMENTS

| | | | | |
|---|---|---|---|---|
| 5,249,319 | A | 10/1993 | Higgs | 5/714 |
| 5,416,935 | A | 5/1995 | Nieh | 5/423 |
| 5,473,783 | A | 12/1995 | Allen | 5/652.2 |
| 5,498,278 | A | 3/1996 | Edlund | 96/11 |
| 5,611,096 | A | 3/1997 | Bartlett et al. | 5/617 |
| 5,640,728 | A | 6/1997 | Graebe | 5/606 |
| 5,647,079 | A | 7/1997 | Hakamiun et al. | 5/713 |
| 5,681,368 | A | 10/1997 | Rahimzadeh | 95/19 |
| 5,701,621 | A | 12/1997 | Landi et al. | 5/691 |
| 5,755,000 | A | 5/1998 | Thompson | 5/713 |
| 5,882,349 | A | 3/1999 | Wilkerson et al. | 604/289 |
| 5,887,304 | A | 3/1999 | Von der Heyde | 5/726 |
| 5,926,884 | A | 7/1999 | Biggie et al. | 5/714 |
| 6,065,166 | A | 5/2000 | Sharrock et al. | 5/630 |
| 6,085,369 | A | 7/2000 | Feher | 5/423 |
| 6,182,315 | B1 | 2/2001 | Lee | 5/690 |
| 6,272,707 | B1 | 8/2001 | Robrecht et al. | 5/724 |
| 6,288,076 | B1 | 9/2001 | Kostyniak et al. | 514/299 |
| 6,336,237 | B1 | 1/2002 | Schmid | 5/726 |
| 6,341,395 | B1 | 1/2002 | Chao | 5/423 |
| 6,353,950 | B1 | 3/2002 | Bartlett et al. | 5/617 |
| 6,418,579 | B2 | 7/2002 | Perez et al. | 5/713 |
| 6,421,859 | B1 | 7/2002 | Hicks et al. | 5/722 |
| 6,487,739 | B1 | 12/2002 | Harker | 5/729 |
| 6,493,889 | B2 | 12/2002 | Kocurek | 5/423 |
| 6,527,832 | B2 | 3/2003 | Oku et al. | 96/4 |
| 6,546,576 | B1 | 4/2003 | Lin | 5/423 |
| 6,671,911 | B1 | 1/2004 | Hill et al. | 5/713 |
| 6,687,937 | B2 | 2/2004 | Harker | 5/726 |
| 6,709,492 | B1 | 3/2004 | Spadaccini et al. | 96/6 |
| 6,779,592 | B1 | 8/2004 | Ichigaya | 165/46 |
| 6,782,574 | B2 | 8/2004 | Totton et al. | 5/713 |
| 6,868,569 | B2 | 3/2005 | VanSteenburg | 5/709 |
| 6,904,629 | B2 | 6/2005 | Wu | 165/46 |
| 7,036,163 | B2 | 5/2006 | Schmid | 5/423 |
| 7,043,767 | B2 * | 5/2006 | Jaeger | 2/87 |
| 7,140,495 | B2 | 11/2006 | Hester et al. | 210/490 |
| 7,165,281 | B2 | 1/2007 | Larsson et al. | 5/724 |
| 7,191,482 | B2 | 3/2007 | Romano et al. | 5/714 |
| 7,240,386 | B1 | 7/2007 | McKay et al. | 5/724 |
| 7,290,300 | B1 | 11/2007 | Khambete | 5/423 |
| 7,296,315 | B2 | 11/2007 | Totton et al. | 5/737 |
| 7,311,685 | B1 * | 12/2007 | Policastro, Jr. | 602/3 |
| 7,334,280 | B1 | 2/2008 | Swartzburg | 5/724 |
| 7,357,830 | B2 | 4/2008 | Weidmann | 96/7 |
| 7,469,432 | B2 * | 12/2008 | Chambers | 5/423 |
| 7,480,953 | B2 | 1/2009 | Romano et al. | 5/714 |
| 7,631,377 | B1 | 12/2009 | Sanford | 5/423 |
| 7,637,573 | B2 | 12/2009 | Bajic et al. | 297/452.43 |
| 7,712,164 | B2 | 5/2010 | Chambers | 5/423 |
| 7,886,385 | B2 | 2/2011 | Carlitz | 5/691 |
| 7,913,332 | B1 | 3/2011 | Barnhart | 5/423 |
| 7,914,611 | B2 | 3/2011 | Vrzalik et al. | 96/11 |
| 7,937,789 | B2 | 5/2011 | Feher | 5/423 |
| 7,937,791 | B2 | 5/2011 | Meyer et al. | 5/727 |
| 7,966,680 | B2 | 6/2011 | Romano et al. | 5/713 |
| 8,118,920 | B2 | 2/2012 | Vrzalik et al. | 96/11 |
| 2001/0023512 | A1 | 9/2001 | Perez et al. | 5/713 |
| 2002/0073489 | A1 | 6/2002 | Totton et al. | 5/713 |
| 2002/0129449 | A1 | 9/2002 | Harker | 5/726 |
| 2002/0148047 | A1 | 10/2002 | Corzani et al. | 5/738 |
| 2003/0019044 | A1 | 1/2003 | Larsson et al. | 5/724 |
| 2003/0145380 | A1 | 8/2003 | Schmid | 5/423 |
| 2004/0003471 | A1 | 1/2004 | VanSteenburg | 5/709 |
| 2004/0064888 | A1 | 4/2004 | Wu | 5/423 |
| 2004/0214495 | A1 | 10/2004 | Foss et al. | 442/199 |
| 2004/0237203 | A1 | 12/2004 | Romano et al. | 5/713 |
| 2005/0011009 | A1 | 1/2005 | Wu | 5/729 |
| 2005/0022308 | A1 | 2/2005 | Totton et al. | 5/713 |
| 2005/0086739 | A1 | 4/2005 | Wu | 5/423 |
| 2005/0188467 | A1 | 9/2005 | Woolfson | 5/726 |
| 2005/0278863 | A1 | 12/2005 | Bahash et al. | 5/726 |
| 2006/0010607 | A1 | 1/2006 | Schneider | 5/713 |
| 2006/0080778 | A1 * | 4/2006 | Chambers | 5/652.2 |
| 2007/0056116 | A1 | 3/2007 | Galardo | 5/724 |
| 2007/0234481 | A1 | 10/2007 | Totton et al. | 5/714 |
| 2007/0261548 | A1 * | 11/2007 | Vrzalik et al. | 95/52 |
| 2007/0266499 | A1 | 11/2007 | O'Keefe et al. | 5/713 |
| 2007/0283498 | A1 * | 12/2007 | Shelby | 5/706 |
| 2008/0028536 | A1 | 2/2008 | Hadden-Cook | 5/724 |
| 2008/0060131 | A1 | 3/2008 | Tompkins | 5/423 |
| 2008/0098529 | A1 * | 5/2008 | Flocard et al. | 5/652.2 |
| 2008/0263776 | A1 | 10/2008 | O'Reagan et al. | 5/714 |
| 2009/0322124 | A1 | 12/2009 | Barkow et al. | 297/180.14 |
| 2010/0043143 | A1 | 2/2010 | O'Reagan et al. | 5/421 |
| 2010/0095461 | A1 | 4/2010 | Romano et al. | 5/710 |
| 2010/0175196 | A1 | 7/2010 | Lafleche et al. | 5/707 |
| 2010/0287701 | A1 | 11/2010 | Frias | 5/423 |
| 2011/0004997 | A1 | 1/2011 | Hale et al. | 5/699 |
| 2011/0010850 | A1 | 1/2011 | Frias | 5/423 |
| 2011/0010855 | A1 | 1/2011 | Flessate | 5/484 |
| 2011/0035880 | A1 | 2/2011 | Cole et al. | 5/423 |
| 2011/0107514 | A1 | 5/2011 | Brykalski et al. | 5/421 |
| 2011/0154575 | A1 | 6/2011 | Kiser | 5/706 |

FOREIGN PATENT DOCUMENTS

| | | |
|---|---|---|
| DE | 203 09 794 | 10/2003 |
| EP | 0870449 | 10/1998 |
| EP | 1151698 | 11/2001 |
| EP | 2319474 | 10/2005 |
| EP | 1645258 | 4/2006 |
| EP | 1687139 | 8/2006 |
| EP | 1863369 | 12/2007 |
| EP | 1901636 | 3/2008 |
| EP | 1919328 | 5/2008 |
| EP | 1971246 | 9/2008 |
| EP | 2047770 | 4/2009 |
| EP | 2258242 | 12/2010 |
| EP | WO 2011/067720 | 6/2011 |
| GB | 2 235 872 | 3/1991 |
| JP | H02-11144 | 1/1990 |
| JP | 11-164757 | 6/1999 |
| JP | 11-169262 | 6/1999 |
| JP | 11-332697 | 12/1999 |
| JP | 2000-152854 | 6/2000 |
| JP | 2002-125809 | 5/2002 |
| JP | 200361790 A | 3/2003 |
| JP | 3094910 U | 4/2003 |
| JP | 2003-230605 | 8/2003 |
| JP | 2004-188052 | 7/2004 |
| JP | 2006109896 A | 4/2006 |
| WO | WO 2004/082551 | 9/2004 |
| WO | WO 2005/046988 | 5/2005 |
| WO | WO 2006/105169 | 10/2006 |
| WO | WO 2006/122614 | 11/2006 |
| WO | WO 2007/003018 | 1/2007 |
| WO | WO 2007/034311 | 3/2007 |

OTHER PUBLICATIONS

Extended European Search Report issued in European Patent Application No. 12181372.9, dated Oct. 1, 2012.

International Search Report and Written Opinion, issued in International patent application No. PCT/US2009/065182, dated Jul. 6, 2010.

* cited by examiner

MULTI-LAYERED SUPPORT SYSTEM

CROSS-REFERENCE TO RELATED APPLICATIONS

This application claims priority to U.S. Provisional Patent Application No. 61/116,095, filed Nov. 19, 2008, the entire disclosure of which is specifically incorporated herein by reference. U.S. Provisional Patent Application No. 60/799,526, filed May 11, 2006, U.S. Provisional Patent Application No. 60/874,210, filed Dec. 11, 2006, and U.S. patent application Ser. No. 11/746,953, filed May 10, 2007, are also incorporated by reference herein without disclaimer.

FIELD OF THE INVENTION

The present disclosure relates generally to support surfaces for independent use and for use in association with beds and other support platforms, and more particularly but not by way of limitation to support surfaces that aid in the prevention, reduction, and/or treatment of decubitus ulcers and the transfer of moisture and/or heat from the body.

BACKGROUND

Patients and other persons restricted to bed for extended periods incur the risk of forming decubitus ulcers. Decubitus ulcers (commonly known as bed sores, pressure sores, pressure ulcers, etc.) can be formed when blood supplying the capillaries below the skin tissue is interrupted due to external pressure against the skin. This pressure can be greater than the internal blood pressure within a capillary and thus, occlude the capillary and prevent oxygen and nutrients from reaching the area of the skin in which the pressure is exerted. Moreover, moisture and heat on and around the person can exacerbate ulcers by causing skin maceration, among other associated problems.

SUMMARY

Exemplary embodiments of the present disclosure are directed to apparatus, systems and methods to aid in the prevention of decubitus ulcer formation and/or promote the healing of such ulcer formation. Certain exemplary embodiments comprise a multi-layer support system that can be utilized to aid in the removal of moisture, vapor, and heat adjacent and proximal the patient surface interface and in the environment surrounding the patient. Certain exemplary embodiments provide a surface that absorbs and/or disperses the moisture, vapor, and heat from the patient.

BRIEF DESCRIPTION OF THE DRAWINGS

While exemplary embodiments of the present invention have been shown and described in detail below, it will be clear to the person skilled in the art that changes and modifications may be made without departing from the scope of the invention. As such, that which is set forth in the following description and accompanying drawings is offered by way of illustration only and not as a limitation. The actual scope of the invention is intended to be defined by the following claims, along with the full range of equivalents to which such claims are entitled.

In addition, one of ordinary skill in the art will appreciate upon reading and understanding this disclosure that other variations for the invention described herein can be included within the scope of the present invention. For example, portions of the support system shown and described may be incorporated with existing mattresses or support materials. Other embodiments may utilize the support system in seating applications, including but not limited to, wheelchairs, chairs, recliners, benches, etc.

In the following Detailed Description of Disclosed Embodiments, various features are grouped together in several embodiments for the purpose of streamlining the disclosure. This method of disclosure is not to be interpreted as reflecting an intention that exemplary embodiments of the invention require more features than are expressly recited in each claim. Rather, as the following claims reflect, inventive subject matter lies in less than all features of a single disclosed embodiment. Thus, the following claims are hereby incorporated into the Detailed Description of Disclosed Embodiments, with each claim standing on its own as a separate embodiment.

Figure 1:
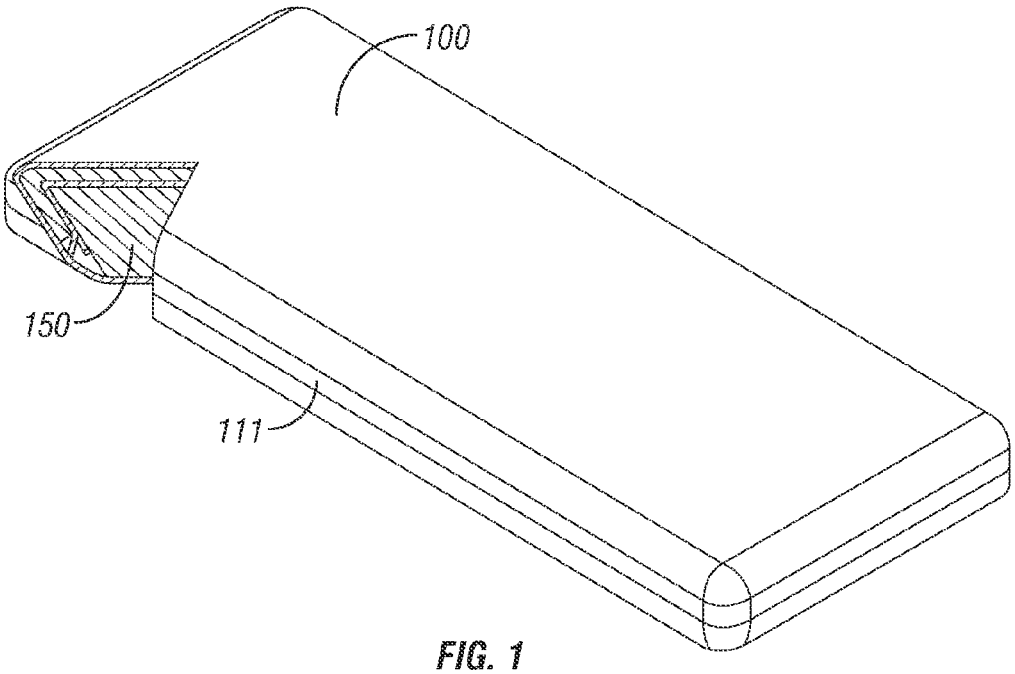

FIG. 1 illustrates a partial section perspective view of an exemplary embodiment of a support system coupled to a support member.

Figure 2A:
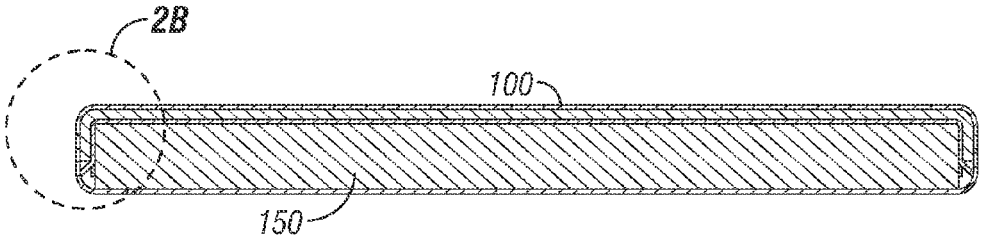
Figure 2B:
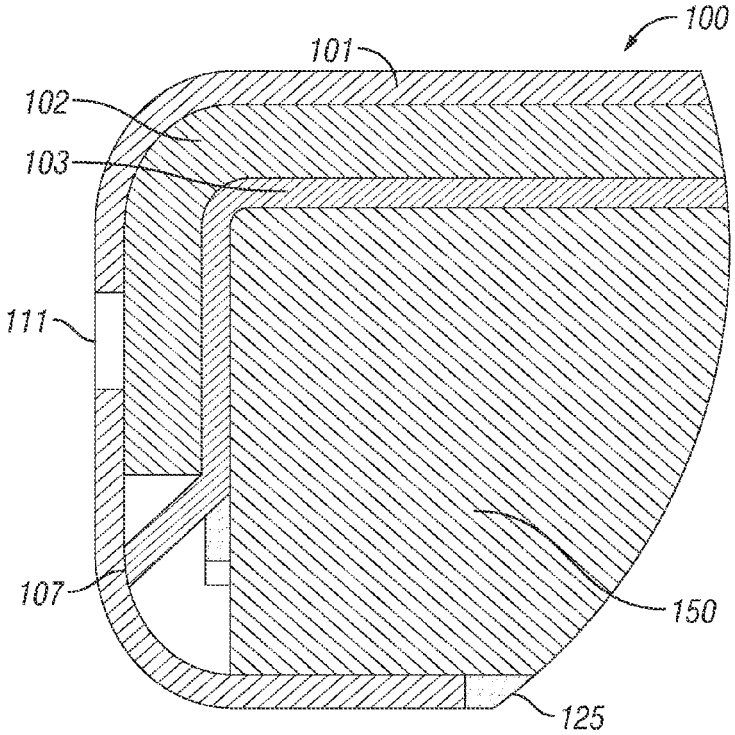

FIG. 2 illustrates a section view and detailed section view of the exemplary embodiment of FIG. 1.

Figure 3:
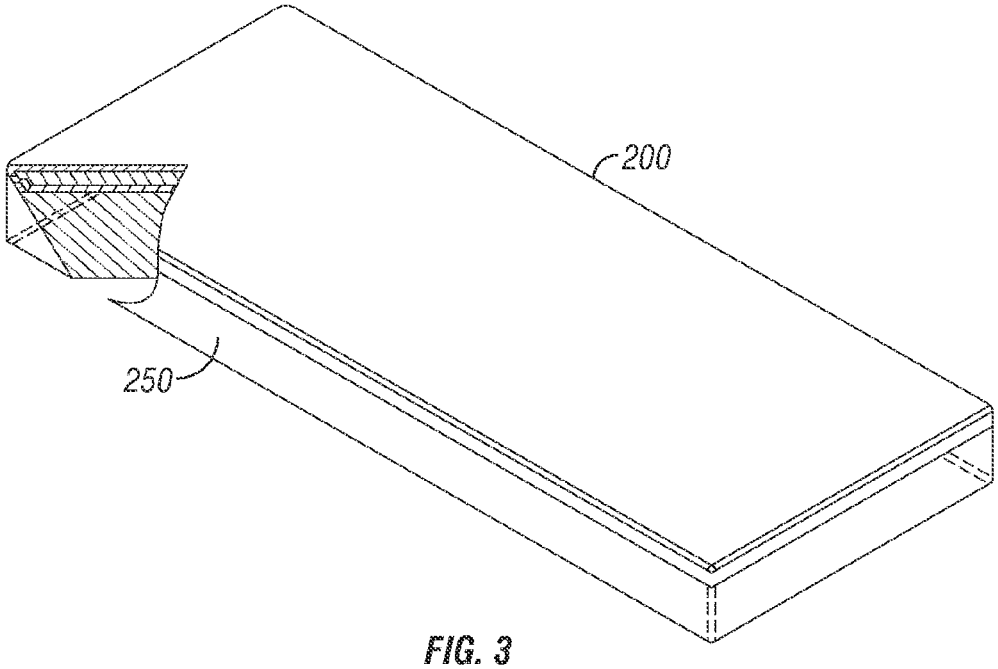

FIG. 3 illustrates a partial section perspective view of an exemplary embodiment of a support system coupled to a support member.

Figure 4A:
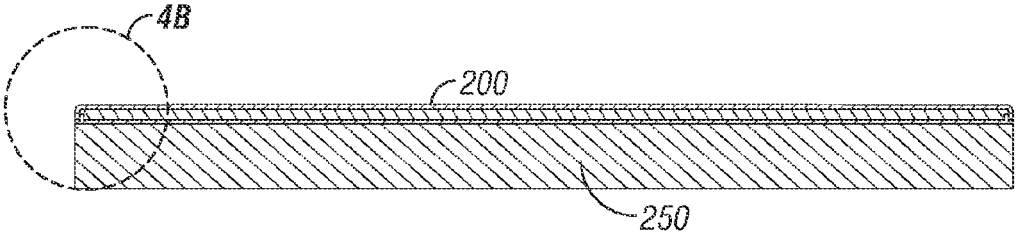
Figure 4:
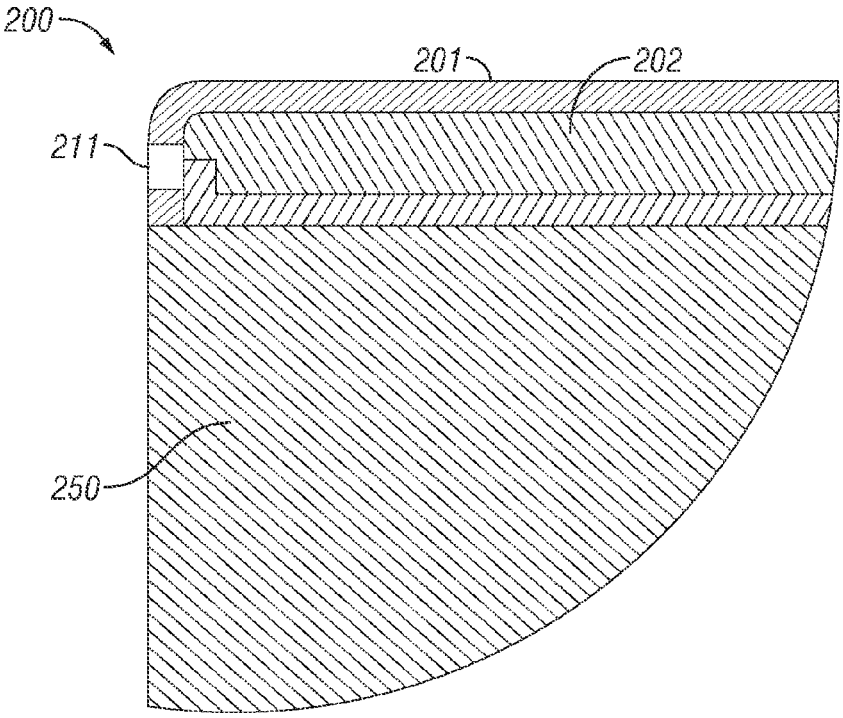
Figure 5A:
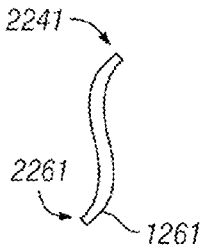
Figure 5B:
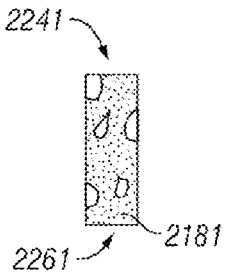
Figure 5C:
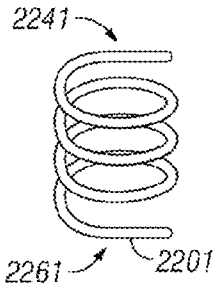
Figure 5D:
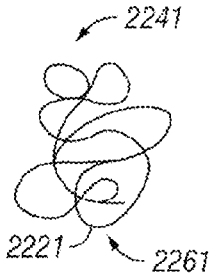

FIG. 4 illustrates a section view and detailed section view of the exemplary embodiment of FIG. 3.

FIGS. 5A-5D illustrate various exemplary embodiments of a flexible material of a multi-layer cover sheet.

FIGS. 6A-6D illustrate various exemplary embodiments of the second layer of the multi-layer cover sheet.

DETAILED DESCRIPTION OF EXEMPLARY EMBODIMENTS

Exemplary embodiments of the present disclosure are directed to apparatus, systems and methods to remove moisture vapor from an interface between a support surface and a person. Certain exemplary embodiments may also be used to aid in the prevention of decubitus ulcer formation and/or promote the healing of such ulcer formation. For example, in various embodiments, preventing ulcer formation and/or healing decubitus ulcers can be accomplished through the use of a multi-layer support system. Exemplary embodiments of the multi-layer support system can be utilized to aid in the removal of moisture, vapor, and heat adjacent and proximal the patient surface interface and in the environment surrounding the patient by providing a surface that absorbs and/or disperses the moisture, vapor, and heat from the patient.

In exemplary embodiments, the multi-layer support system may include materials that provide for a low air loss feature, where one or more layers exhibit various air, vapor, and liquid permeable properties and/or where one or more layers are fastened together along various portions of a perimeter of the multi-layer support system to define openings through which air can move from inside to outside the multi-layer support system, as will be described herein. As used herein, a low air loss feature of a multi-layer support system includes, but is not limited to: a multi-layer support system that allows air and vapor to pass through the first layer in the presence of a partial pressure difference in vapor between the internal and external environments of the multi-layer support system.

In other exemplary embodiments, the multi-layer support system can include materials that provide for substantially no air flow, where one or more layers include air impermeable properties and/or where layers are partially fastened together along the perimeter of the multi-layer coversheet. In such exemplary embodiments, this configuration may control the direction of movement of air from inside to outside (e.g., under influence by a source of positive pressure) and from outside to inside (e.g., under influence by a source of negative pressure) the multi-layer support system. Certain exemplary embodiments comprise a multi-layer support system includes, but is not limited to, the following: a support system that prevents or substantially prevents air from passing through the first layer, but allows for the passing of vapor through the first layer; a support system that prevents or substantially prevents air from moving through the first layer in the presence of a partial vapor pressure difference between the internal and external environments of the multi-layer support system, but allows for the passing of vapor through the first layer; and a support system that prevents or substantially prevents air from moving out of the multi-layer support system via the material forming a particular layer of the support system, but allows air to move through the openings defined by portions of the perimeter of the multi-layer support system that are fastened together.

In various exemplary embodiments, systems are provided that can include a number of components that both aid in prevention of decubitus ulcer formation and to remove moisture and/or heat from the patient. For example, systems can include a multi-layer support system that can be used in conjunction with a variety of support surfaces, such as an inflatable mattress, a foam mattress, a gel mattress, a water mattress, or a RIK® Fluid Mattress of a hospital bed. In such exemplary embodiments, features of the multi-layer support system can help to remove moisture from the patient, while features of the mattress can aid in the prevention and/or healing of decubitus ulcers by further lowering interface pressures at areas of the skin in which external pressures are typically high, as for example, at bony prominences such as the heel and the hip area of the patient. In other exemplary embodiments, systems can include the multi-layer support system used in conjunction with a chair or other support platform.

Referring initially to FIGS. 1 and 2, a support system 100 is shown coupled to a mattress 150. In this embodiment, support system 100 is configured to extend around the sides of mattress 150 and to the lower surface of mattress 150. Mattress 150 can be any configuration known in the art for supporting a person. For example, in certain exemplary embodiments, mattress 150 may be an alternating-pressure-pad-type mattress or other type of mattress utilizing air to inflate or pressurize a cell or chamber within the mattress. In other exemplary embodiments, mattress 150 does not utilize air to support a person.

Support system 100 may be coupled to mattress 150 via a coupling member 125. In certain embodiments, coupling member 125 may comprise elastic. In other embodiments, coupling member 125 may comprise a hook-and-loop fastener, buttons, snaps, zippers, or other suitable coupling devices. In certain embodiments, support system 100 may not comprise a coupling member and may be coupled to mattress 150 by tucking material (e.g. first layer 101 and/or third layer 103) from support system 100 under mattress 150.

FIG. 1 discloses a partial section perspective view of support system 100 mounted on mattress 150. FIG. 2 discloses a cross section of support system 100 and mattress 150, as well as a detailed view of an end portion. As shown in this exemplary embodiment, support system 100 comprises a first layer 101, a second layer 102, and a third layer 103. In this embodiment, support system 100 is configured so that first layer 101 is the layer that will contact a patient (not shown) that is supported by support system 100. Support system is also configured so that second layer 102 is between first layer 101 and third layer 103, which is proximal to mattress 150.

In this exemplary embodiment, first layer 101 comprises a material that is vapor permeable. In specific embodiments, first layer 101 also comprises a material that is liquid and air impermeable. Examples of such materials include poly (tetrafluoroethylene) (PTFE) materials and urethane-coated fabric. In other embodiments, first layer 101 may comprise a material that is vapor and air permeable and liquid impermeable. One example of such material is sold under the trade name GoreTex.™

In the illustrated exemplary embodiment, second layer 102 comprises a spacer material that separates first layer 101 and third layer 103. As used in this disclosure, the term "spacer material" (and related terms) should be construed broadly to include any material that includes a volume of air within the material (e.g., "air pockets") and allows air to move through the material. In exemplary embodiments, spacer materials allow air to flow through the material when a person is laying on the material while the material is supported by a mattress. Examples of such spacer materials include open cell foam, polymer particles, and a material sold by Tytex under the trade name AirX™.

In the exemplary embodiment shown, third layer 103 comprises a material that is vapor impermeable. In certain embodiments, third layer 103 is also air impermeable and liquid impermeable. Examples of such material include sheet vinyl plastic or sheet polyurethane material. In certain embodiments, first layer 101 and third layer 103 are coupled at an interface 107 via a process such as radio frequency welding, heat sealing, sonic welding, or other comparable techniques. In certain embodiments, interface 107 does not extend continuously around the entire periphery of support system 100. Instead, first layer 101 and third layer 103 may be intermittently coupled together around the periphery of support system 100 to form interface 107. In certain embodiments, first layer 101 and third layer 103 may be comprised of the same material in certain embodiments.

Referring now to FIGS. 3 and 4, another exemplary embodiment comprises a support system 200 on top of a mattress 250. Support system 200 is similar to support system 100, but does not include portions that extend around the sides of mattress 250 and to the lower surface of mattress 250. Instead, support system 200 is configured to lay on top of mattress 250. Support system 200 may comprise straps or other fastening members (not shown) configured to hold support system 200 in place on mattress 250.

Similar features in support system 200 are referenced with numbers similar to those used in the description of support system 100, with the exception that the reference numbers begin with a "2" instead of a "1". For sake of brevity, a description of equivalent features and functions will not be repeated for support system 200.

During use, a person (not shown) can lay on top of support system 100. In the exemplary embodiment shown, moisture vapor can be transferred from the person (and the air adjacent person) through first layer 101 to air pockets within second layer 102 that are located in the area underneath the person. Moisture vapor will continue to transfer to air pockets within second layer 102 while the air pockets are at a lower relative humidity than the air adjacent the person. The relative humidity of the air pockets located underneath the person will then increase to a level that exceeds the relative humidity of the air pockets in the areas that are not underneath the person. As a result, the moisture vapor will move from the air pockets underneath the patient to air pockets that are in areas away from the patient (e.g., towards the perimeter of support system 100 or those areas of second layer 102 that are proximal to the sides and/or ends of support system 100).

With the migration of moisture vapor toward the perimeter of support system 100, the relative humidity of air pockets in the areas closer to the perimeter will increase to a level that exceeds the relative humidity of the environment above first layer 101. As a result of this difference in relative humidity, moisture vapor will transfer from the air pockets, through first layer 101 and into the environment surrounding the support system 100. This will reduce the relative humidity of the air pockets in the areas near the perimeter of support system and allow further migration of moisture vapor from the air pockets in the areas underneath the person to the air pockets in the areas proximal to the perimeter of support system 100. After a sufficient period of time, the process will reach a steady-state condition so that moisture vapor is transferred in the following manner: (1) from the interface between the person and the patient support surface, through first layer 101, and into the air pockets of second layer 102 in the area underneath the person; (2) from the air pockets in second layer 102 in the area underneath the person to air pockets in second layer 102 in the areas that are proximal to the perimeter of support system 100; and (3) from the air pockets in the areas that are proximal to the perimeter of support system 100, through first layer 101, and into the environment above first layer 101 and proximal to the perimeter of support system 100.

In certain exemplary embodiments, first layer 101 comprises a portion 111 proximal to the perimeter of support system 100 that is configured to increase the moisture vapor transfer rate through first layer 101. In certain embodiments, portion 111 may comprise a different material than the remainder of first layer 101. For example, portion 111 may comprise a highly porous material that has a higher vapor permeability than the remainder of first layer 101. In certain embodiments, portion 111 may also be permeable to air and liquid. In other embodiments, portion 111 may comprise a slit or other aperture in first layer 101.

In exemplary embodiments, the transfer of moisture vapor in the above-described manner is accomplished without an air mover. The transfer of moisture vapor can be accomplished by the difference in partial pressure of the vapor in the areas with differing relative humidity. Providing for the transfer of moisture vapor without an air mover can reduce the manufacturing cost of support system 100. It can also allow support system 100 to be used in areas in which electrical power is not available.

In exemplary embodiments, second layer 102 is sufficiently thick so that it maintains air pockets in the areas underneath a person being supported by support system 100. In certain embodiments, however, second layer 102 is not so thick that it significantly reduces the interface pressure exerted on the person being supported by support system 100. For example, in certain exemplary embodiments, second layer is 0.5, 0.375, 0.25 or 0.125 inches thick. Minimizing the thickness of second layer 102 can reduce the manufacturing costs for support system 100. In addition, minimizing the thickness of second layer 102 can help to maintain a desired distance between the top of support system 100 (e.g., the top of first layer 101) and the top of side rails that may be used on a bed in which support system 100 is utilized. Maintaining this distance will increase the likelihood that the siderails will retain the patient in the bed should the patient roll towards one side or the other. In specific embodiments, support system 100 is configured so that the interface pressure is not significantly reduced by the addition of support system 100 to a mattress or other support surface. In certain embodiments, the interface pressure is not reduced by more than 10 mm Hg as compared to the interface pressure. In this disclosure, the interface pressure is measured according to the procedure disclosed in Reger S I, Adams T C, Maklebust J A, Sahgal V: Validation Test for Climate Control on Air Loss Supports; Arch. Phys. Med Rehab. 2001; 82:597-603, herein incorporated by reference.

In various exemplary embodiments, second layer 102 can be formed of various materials, and can have a number of configurations and shapes, as described herein. In some embodiments, the material is flexible. In such exemplary embodiments, the flexible material can include properties that resist compression, such that when the flexible material is subject to a compressive load, for example, by the weight of a patient lying on the multi-layer support system, the flexible material has a tendency to return toward its original shape, and thereby impart a supportive function to the multi-layer support system. The flexible material can also include a property that allows for lateral movement of air through the flexible material even under a compressive load.

Examples of materials that can be used to form second layer 102 can include, but are not limited to, natural and synthetic polymers in the form of particles, filaments, strands, foam (e.g., open cell foam), among others, and natural and synthetic materials such as cotton fibers, polyester fibers, and the like. Other materials can include flexible metals and metal alloys, shape memory metals and metal alloys, and shape memory plastics. These materials can include elastic, super elastic, linear elastic, and/or shape memory properties that allow the flexible material to flex and bend and to form varying shapes under varying conditions (e.g., compression, strain, temperature, etc.).

FIGS. 5A-5D illustrate exemplary various embodiments of a spacer material of the multi-layer support system 100. In various embodiments of FIGS. 5A-5D, the flexible material can include a number of cross-sectional geometric shapes, including but not limited to, circular, ovular, polygonal, and irregular geometric shapes. For example, as shown in FIGS. 5A-5D, the flexible material can include a strand member 1261, a foam member 2181, a coil member 2201, or a convoluted member 2221, or a combination thereof, each having a circular cross-sectional shape. Each of the embodiments illustrated in FIGS. 5A-5D, either alone, or in combination, can provide support to the patient lying on the multi-layer support system, can aid in lowering interface pressures between the patient and the multi-layer support system, and can permit air to flow under the patient, and can function in combination with a support platform or support surface, such as an air mattress, to further reduce interface pressures between the patient and multi-layer coversheet.

In each of FIGS. 5A-5D, the flexible material includes a first and a second end 2241 and 2261. In various exemplary embodiments, first and second ends 2241 and 2261 can include surfaces and/or structures that allow them to attach, connect, couple, hook, trap, and/or anchor to portions of the multilayer support system to secure the flexible member to the support system, as will be described in more detail with respect to FIG. 6A. In some exemplary embodiments, the flexible material forming second layer 102 is not coupled to multi-layer support system 100, but rather is positioned between first and third layers 101 and 103 and secured therein by fastening first and third layers 101 and 103 together to thereby enclose second layer 102, as will be described herein below.

In exemplary embodiments, the flexible material can also facilitate at least a flow of air through the second layer. For example, in various exemplary embodiments, the flexible material can include configurations that define openings, channels, and passages that allow for air, vapor, and liquid to flow through the second layer. In one exemplary embodiment, the flexible material can include a non-continuous configuration where individual components, such as individual strands or fibers, and other individual components are not connected to each other, but rather, are connected to one or more attachment surfaces or structures defined by sub-layers of the second layer 104, as will be described in connection with FIGS. 6A-6D.

FIGS. 6A-6D illustrate various embodiments of the second layer of the multi-layer support system. In the embodiment illustrated in FIG. 6A, a detailed view of second layer 102 includes a first sub-layer 3081, a second sub-layer 3101, and a third sub-layer 3121. In this embodiment, first sub-layer 3081 and third sub-layer 3121 can define a number of attachment structures or surfaces 3141 on which second sub-layer 3101 can attach. In various exemplary embodiments, second sub-layer 3101 can be, for example, any of the flexible materials illustrated in FIGS. 5A-5D, or second sub-layer 3101 can be formed of other materials that provide both a supporting function to the patient and facilitate a flow of air under the patient.

In various exemplary embodiments, the attachment surfaces 3141 can include inner surfaces and/or outer surfaces and/or openings of first and third sub-layers 3081 and 3121 on which the flexible material can directly attach, anchor, connect, etc, and through which air, vapor, and liquid can pass. In addition, first and third sub-layers 3081 and 3121 can be formed of a number of different materials each having a rigid, semi-rigid, or flexible property.

Figure 6A:
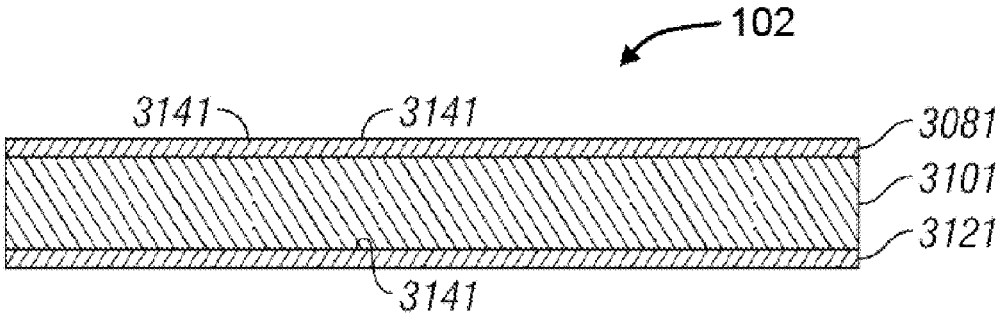
Figure 6B:
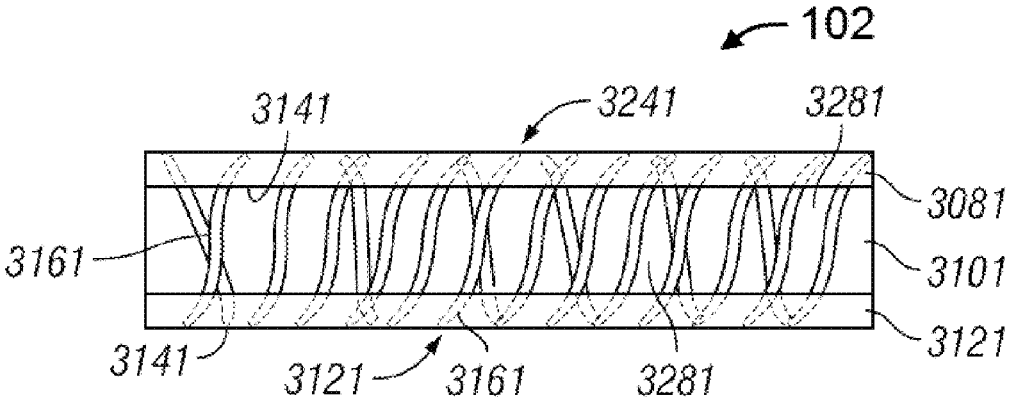

FIG. 6B illustrates a cross-sectional view of an exemplary embodiment of second layer 102 of multi-layer support system 100. As shown in FIG. 6B, second sub-layer 3101 of second layer 102 includes a flexible material formed of a number of individual strand members 3161 extending between first and third sub-layers 3081 and 3121 and attaching to first and third sub-layers 3081 and 3121 at various locations on first and third sub-layers 3081 and 3121. In this embodiment, first and third sub-layers 3081 and 3121 also include a flexible material, such that all three sub-layers of second layer 102 can bend or flex under compressive forces. As shown in FIG. 6B, strand members 3161 define channels and openings 3281 within second sub-layer 3101 that facilitate the movement of air, vapor, and liquid through second layer 102. In addition, openings (not shown in FIG. 6B) can be defined by surfaces of first and third sub-layers 3081 and 3121 and thus, can also facilitate the movement of air, and/or vapor, and/or liquid therethrough.

Figure 6C:
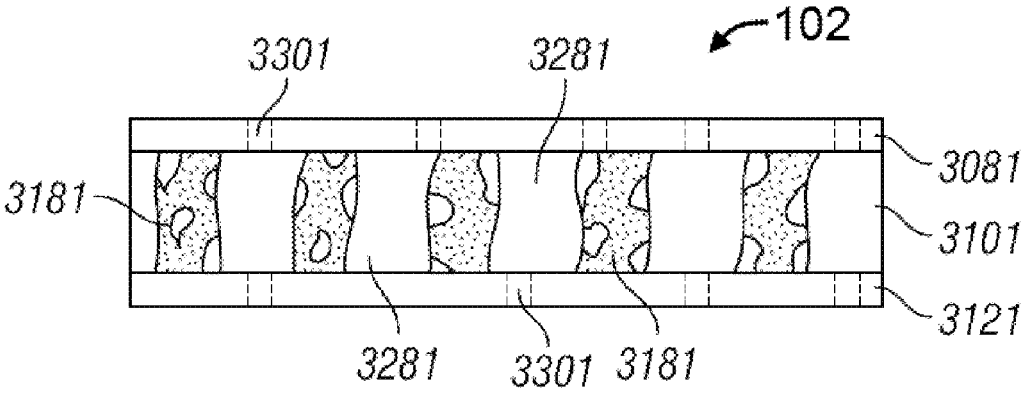

FIG. 6C illustrates a cross-sectional view of another exemplary embodiment of the second layer 102 of the multi-layer support system 100. As shown in FIG. 6B, the second layer 102 includes the first, second, and third sub-layers 3081, 3101, and 3121. The flexible material forming second sub-layer 3101 of second layer 102 includes a number of individual foam members 3181. Each foam member includes a porous or open cell structure that facilitates the movement of vapor, air, and liquid through foam members 3181. The foam members include a spaced apart configuration to define passages or openings 3281 that further facilitate the movement of air, vapor, and liquid therethrough. In addition, openings 3301 defined by the first and third sub-layers 3081 and 3121 also facilitate the movement of vapor, air, and liquid therethrough.

In various exemplary embodiments of FIGS. 6A-6C, the flexible material can be chemically attached to the first and third sub-layers 3081 and 3121 through the use of adhesives, and the like, and/or mechanically attached through the use of fasteners such as stitches, clasps, hook and loop, and the like, and/or physically attached through the use of welds, such as RF welds and related methods. As described herein, the shapes and sizes of the first, second, and third layers of exemplary embodiment of the multi-layer support system, as well as sub-layers of the second layer can vary, and the exemplary embodiments illustrated in FIGS. 6A-6C are not limited to rectangular shapes, as shown. Other shapes and sizes are contemplated and can be designed based upon the intended application of the multi-layer support system. For example, in various exemplary embodiments, the shape and size of the support system can be designed based upon the support surface or platform for which it is to be used, such as a chair.

Figure 6D:
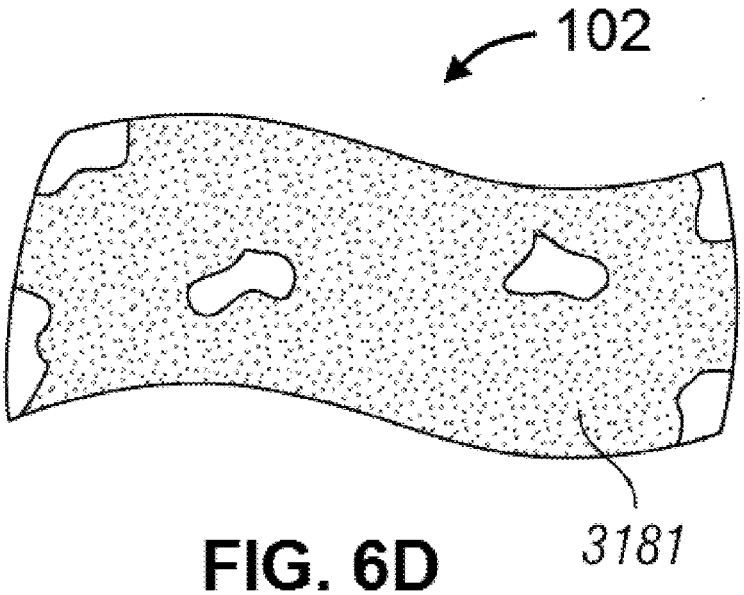

In the exemplary embodiment illustrated in FIG. 6D, the flexible material of second layer 102 includes a single foam member 3181 having an open cell configuration. In this exemplary embodiment, single foam member 3181 is substantially the same perimeter size as the first and third layers 101 and 103 of multi-layer support system 100. In the exemplary embodiment illustrated in FIG. 6D, foam member 3181 can be positioned between first and third layers 101 and 103 and secured by fastening first and third layers 101 and 103 to thereby enclose second layer 102 within first and third layers 101 and 103 of multi-layer support system 100. In various exemplary embodiments, foam member 3181 can include various sizes and shapes. For example, in some exemplary embodiments, single foam member 3181 has a perimeter that is smaller than the perimeter of the first and third layers 101 and 103.

In various exemplary embodiments, first and third layers 101 and 103 can be fastened together such that the entire perimeter of the multi-layer support system is fastened. In other exemplary embodiments, a portion of the perimeter of first and third layers 101 and 103 can be fastened, while remaining portion(s) can be unfastened. In such exemplary embodiments, fastened portions, which are adjacent to unfastened portions of the perimeter, define a number openings (i.e., areas of the perimeter that are not fastened) through which air and vapor can move. The fastening of first and third layers 101 and 103 can include any number of techniques, including those described above in connection with fastening second layer 102 to first and third layers 101 and 103. For example, in some exemplary embodiments, portions of first and third layers 101 and 103 are fastened together by stitching, while other portions are fastened together through the use of one or more buttons and/or hook and loop fasteners (i.e., VELCRO®) or the like. In other exemplary embodiments, first and third layers 101 and 103 are fastened together by welding them together along their perimeters using high frequency radio energy (i.e., RF welding) or ultrasonic energy (i.e., ultrasonic welding). Other forms of welding are also contemplated.

In various exemplary embodiments, third layer 103 can be formed of a variety of different materials that exhibit various properties. In certain exemplary embodiments, third layer 103 is formed of a vapor impermeable, air impermeable, and a liquid impermeable material. The impermeable property of third layer 103 prevents vapor, air, and liquid from passing through third layer 103 and therefore, prevents exposure of the air, vapor, and liquid to a support surface or platform, on which multi-layer support system 100 is positioned. In addition, third layer 103 can function as a guide to direct the air, vapor, and liquid toward the openings defined by portions of the perimeter not fastened together, or to direct air from the openings and toward an elongate member, as will be described herein. In various embodiments, the third layer can also function as an attachment or coupling layer to attach the multi-layer support system to a support surface or platform. For example, in various embodiments, the third layer can include extensions that can couple to the support surface such as a foam mattress. In such embodiments, the extensions can be wrapped around the support surface and tucked under the support surface or can be attached to the support surface using a variety of fasteners, such as those described herein. In other exemplary embodiments, the outer surface of the third layer can include a number of fasteners such as a hook and loop fasteners. In such exemplary embodiments, the support surface can be provided with a cover having a loop structure, and the third layer can include an outer layer having a hook structure. Other methods and mechanisms are contemplated for attaching the multi-layer support system to a support surface or platform so as to secure the multi-layer support system thereto.

In various exemplary embodiments, the multi-layer support system can be a one-time use support system or a multi-use support system. As used herein, a one-time use support system is a support system for single-patient use applications that is formed of material that is disposable and/or inexpensive and/or manufactured and/or assembled in a low-cost manner and is intended to be used for a single patient over a brief period of time, such as an hour(s), a day, or multiple days. As used herein, a multi-use support system is a support system for multi-patient use that is generally formed of material that is re-usable, washable, can be disinfected using a variety of techniques (e.g., autoclaved, bleach, etc.) and generally of a higher quality and superior in workmanship than the one-time use support system and is intended to be used by one or more patients over a period of time such as multiple days, weeks, months, and/or years. In various exemplary embodiments, manufacturing and/or assembly of a multi-use support system can involve methods that are more complex and more expensive than one-time use coversheets. Examples of materials used to form one-time use support systems can include, but are not limited to, non-woven papers. Examples of materials used to form re-usable support systems can include, but are not limited to, Gore-Tex®, and urethane laminated to fabric.

As one of ordinary skill in the art will appreciate, vapor and air can carry organisms such as bacteria, viruses, and other potentially harmful pathogens. As such, and as will be described in more detail herein, in some embodiments of the present disclosure, one or more antimicrobial devices, agents, etc., can be provided to prevent, destroy, mitigate, repel, trap, and/or contain potentially harmful pathogenic organisms including microbial organisms such as bacteria, viruses, mold, mildew, dust mites, fungi, microbial spores, bioslimes, protozoa, protozoan cysts, and the like, and thus, remove them from air and from vapor that is dispersed and removed from the patient and from the environment surrounding the patient. In addition, in various embodiments, support system 100 can include various layers having antimicrobial activity. In some embodiments, for example, first, second, and or third layers 101, 102, and 103 can include particles, fibers, threads, etc., formed of silver and/or other antimicrobial agents. Other antimicrobial devices and agents are also contemplated.

The invention claimed is:

1. A support system for supporting a person, the support system comprising:
- a first layer on which a person is supported, the first layer comprising a vapor permeable material;
- a second layer comprising a spacer material; and
- a third layer,
- wherein:
  - the second layer is between the first layer and the third layer;
  - and the support system is configured to achieve a steady state system in which moisture vapor transfers:
    - (1) through the first layer and into the spacer material of the second layer positioned beneath the person:
    - (2) within the second layer from the spacer material positioned beneath the person towards a lateral perimeter of the support system; and
    - (3) from the spacer material at a location proximal to the lateral perimeter through the first layer,
- wherein the first layer comprises a portion proximal to the lateral perimeter of the support system that is configured to increase the vapor transfer rate through the first layer;
- wherein the support system does not comprise an air mover configured to move air inside or outside of the support system, and
- wherein the portion proximal to the lateral perimeter of the support system comprises a different material than the remainder of the first layer.

2. The support system of claim 1 wherein the thickness of the spacer material of the second layer is 0.5 inches or less.

3. The support system of claim 1 wherein the thickness of the spacer material of the second layer is 0.375 inches or less.

4. The support system of claim 1 wherein the thickness of the spacer material of the second layer is 0.25 inches or less.

5. The support system of claim 1 wherein the support system is configured so that the support system does not reduce the interface pressure by more than 10 mm Hg.

6. The support system of claim 1 wherein the support system is configured so that during use:
- moisture vapor will transfer through the first layer and into a first portion of the spacer material in an area underneath a person supported by the support system:
- moisture vapor will transfer from the first portion of the spacer material to a second portion of the spacer material that is proximal to the lateral perimeter of the support system; and
- moisture vapor will transfer from the second portion of the spacer material through the first layer and into the environment outside of the support system.

7. The support system of claim 1 wherein the support system is configured to be coupled to a mattress.

8. The support system of claim 1 wherein the support system is configured to be coupled to a chair.

9. The support system of claim 1, further comprising a coupling member configured to couple the support system to a support member.

10. The support system of claim 9 wherein the support member is a mattress.

11. The support system of claim 9 wherein the support member is a chair.

12. The support system of claim 9 wherein the coupling member is selected from the group consisting of: a strap, zipper, button, buckle, and hook-and-loop fastener.

13. The system of claim 1 wherein the spacer material comprises one of the following: open cell foam; natural or synthetic polymer particles, filaments, or strands; cotton fibers: polyester fibers; flexible metals and metal alloys; shape memory metals and metal alloys, and shape memory plastics.

14. A support system for supporting a person, the support system consisting essentially of:

a first layer comprising a vapor permeable material;

a second layer comprising a spacer material; and a third layer, wherein the second layer is between the first layer and the third layer;

wherein the support system is configured to achieve a steady state system in which moisture vapor transfers:

(1) through the first layer and into the spacer material of the second layer positioned beneath the person;

(2) within the second layer from the spacer material positioned beneath the person towards a lateral perimeter of the support system; and (3) from the spacer material at a location proximal to the lateral perimeter through the first layer, wherein the first layer comprises a portion proximal to the lateral perimeter of the support system that is configured to increase the vapor transfer rate through the first layer, and wherein the portion proximal to the lateral perimeter of the support system comprises a different material than the remainder of the first layer.

* * * * *